US008390643B2

(12) United States Patent
Belik et al.

(10) Patent No.: US 8,390,643 B2
(45) Date of Patent: Mar. 5, 2013

(54) DYNAMIC GAMUT CONTROL

(75) Inventors: Oleg Belik, Eindhoven (NL); Dmitry Nikolaevich Znamenskiy, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 985 days.

(21) Appl. No.: 12/441,545

(22) PCT Filed: Sep. 14, 2007

(86) PCT No.: PCT/IB2007/053711

§ 371 (c)(1),
(2), (4) Date: Mar. 17, 2009

(87) PCT Pub. No.: WO2008/035259

PCT Pub. Date: Mar. 27, 2008

(65) Prior Publication Data

US 2010/0020109 A1 Jan. 28, 2010

(30) Foreign Application Priority Data

Sep. 20, 2006 (EP) ..... 06120979

(51) Int. Cl.
*G09G 5/02* (2006.01)

(52) U.S. Cl. ..... 345/590

(58) Field of Classification Search ..... 345/590
See application file for complete search history.

(56) References Cited

U.S. PATENT DOCUMENTS

| | | | | |
|---|---|---|---|---|
| 6,453,067 | B1 * | 9/2002 | Morgan et al. | 382/162 |
| 6,833,888 | B2 * | 12/2004 | Song et al. | 349/106 |
| 6,897,876 | B2 * | 5/2005 | Murdoch et al. | 345/589 |
| 7,176,935 | B2 * | 2/2007 | Higgins | 345/589 |
| 7,209,105 | B2 * | 4/2007 | Elliott | 345/89 |
| 7,531,959 | B2 * | 5/2009 | Hatwar et al. | 313/507 |
| 7,742,205 | B2 * | 6/2010 | Lor et al. | 358/515 |
| 7,990,393 | B2 * | 8/2011 | Higgins | 345/604 |
| 2005/0140612 | A1 | 6/2005 | Baek | |
| 2005/0237596 | A1 | 10/2005 | Selbrede | |
| 2006/0192899 | A1 | 8/2006 | Ogita | |

FOREIGN PATENT DOCUMENTS

| | | | |
|---|---|---|---|
| EP | 1489853 | A2 | 12/2004 |
| EP | 1577872 | A1 | 9/2005 |
| EP | 1737245 | A1 | 12/2006 |

(Continued)

OTHER PUBLICATIONS

Barnard et al., A Comparison of Computational Color Constancy Algorithms—Part II: Experiments With Image Data, IEEE Transactions on Image Processing, vol. 11, No. 9, Sep. 2002, pp. 985-996.*

(Continued)

*Primary Examiner* — Xiao M. Wu
*Assistant Examiner* — Charles Tseng

(57) ABSTRACT

A method of dynamic gamut control is disclosed. In accordance with a first aspect of the invention, control of the intensities of a set of color primaries illuminating associated sub-pixels of a display device is disclosed. Thus, the intensities of the light sources are controlled to control the intensities of the color primaries after the color filters. The method searches for a minimal intensity value of one color primary, which is adjusted to obtain together with the other color primaries of the set of color primaries an adjusted color gamut still containing all the colors of the set of colors.

14 Claims, 5 Drawing Sheets

FOREIGN PATENT DOCUMENTS

WO 2005109903 A1 11/2005

OTHER PUBLICATIONS

Shiga, T. et al "Reduction of LCTV Backlight Power and Enhancement of Gray cale Capability by using an Adaptive Dimming Technique", 2003 SID International Symposium Digest of Technical Papers. vol. 34, No. 2, pp. 1364-1367.

* cited by examiner

DYNAMIC GAMUT CONTROL

FIELD OF THE INVENTION

The invention relates to a method of dynamic gamut control, a dynamic gamut control unit, a display apparatus comprising the dynamic gamut control unit, a handhold apparatus with a display and comprising the dynamic gamut control unit, and a computer program product.

BACKGROUND OF THE INVENTION

Many display apparatuses display images on a display device by using a light unit, which comprises at least one light source for illuminating the pixels of a pixilated display device. Usually, the pixilated display is a matrix display. Usually, in a stable operation state, the light source provides a non-varying light spectrum and the input image is reproduced by modulating the optical state of the pixels. Up till now, predominantly fluorescent lamps are used as the light source. However, LED's, which supply almost monochromatic spectra, are also considered. A known transmissive LCD display comprises pixels made of LC material of which an optical transmission is controlled in accordance with the image to be displayed. In another known reflective DMD display, the pixels comprise small mirrors, which can tilt; an angle of the tilt of the mirrors is controlled in accordance with the image to be displayed. Transflective displays, which partly reflect and partly transmit light from the light sources, are also known.

In a color display device, each one of the pixels comprises sub-pixels and associated color filters to obtain different colors, which together provide the color of the pixel in accordance with the image to be displayed. The colored lights which are leaving the color filters and which illuminate the associated sub-pixels are often referred to as the primary colors of the color display device. These primary colors define the color gamut the display device can display.

For a long time, color display devices used three primary colors, usually red, green and blue. Therefore, almost all input images are defined in a three-component color space, which usually is the RGB color space or a thereto related color space. Recently, the so called multi-primary displays are introduced which use more than three primary colors. It has to be noted that, although "colors" is used in fact is meant different spectrums. Such displays are also referred to as wide gamut displays because a wider color gamut can be displayed by using at least four instead of three primary colors.

Power consumption is an important issue in display apparatus and thus many activities are ongoing to decrease the power consumption. In one of the approaches a wide gamut display, which comprises four sub-pixels per pixel is used in which one of the sub-pixels is white. Usually, the other sub-pixels are red, green and blue, but other colors are possible. It has to be noted that linking a color to a sub-pixel does mean that the light, which is leaving this sub-pixel towards the viewer has the color mentioned.

At a same intensity of the light source, the extra white sub-pixel, which has a transparent color filter, has a much higher luminance than the other sub-pixels because the color filters between the light source and the other sub-pixels suppress a large part of the spectrum. Consequently, the power consumption can be minimized by providing the white part of the color via the white sub-pixel instead of via the other sub-pixels of the pixel. The transparent color filter need not be actually provided but often is present unintentionally because the light leaving the light source has to travel a predetermined distance through the transparent material covering the white sub-pixel.

The use of RGBW display devices with fluorescent lamp as the backlight is limited due to artifacts caused by the RGB to RGBW gamut mapping. In order to make full use of the increased brightness of the RGBW gamut, all the input image components have to be scaled approximately by a factor of two. Unsaturated colors will become two times brighter at the same intensity of the light source, or only half of the intensity of the light source is required to obtain the same brightness. However, saturated colors are scaled outside the RGBW gamut, which leads to undesirable clipping artifacts or unnaturalness after mapping such colors back into the RGBW gamut. These artifacts could be prevented by boosting the intensity of the lamps but this would further increase the power consumption.

SUMMARY OF THE INVENTION

It is an object of the invention to provide a dynamic gamut control for decreasing the power consumption without introducing artifacts.

A first aspect of the invention provides a dynamic gamut control as claimed in claim 1. A second aspect of the invention provides a dynamic gamut control unit as claimed in claim 8. A third aspect of the invention provides a display apparatus as claimed in claim 9. A fourth aspect of the invention provides a handheld apparatus as claimed in claim 13. A fifth aspect of the invention provides a software product as claimed in claim 14. Advantageous embodiments are defined in the dependent claims.

The method of dynamic gamut control in accordance with the first aspect of the invention controls the intensities of a set of color primaries illuminating associated sub-pixels of a display device. For example, the intensities of the light sources are controlled to control the intensities of the color primaries after the color filters. The method searches for a minimal intensity value of the one color primary, which is adjusted to obtain together with the other color primaries of the set of color primaries an adjusted color gamut still containing all the colors of the set of colors. The minimal intensity value is found by first, for each color of the set of colors, determining the minimal intensity value of the color primary which is adjusted to obtain the adjusted color gamut wherein the selected color of the set of colors lies substantially on a boundary of the adjusted color gamut, and then selecting the maximum value of the determined minimum intensity values of the adjusted color primary for each one of the colors. The color may lie exactly on the boundary, but may have a small offset with respect to the boundary due to quantization errors. It has to be noted that also the boundary may comprise quantizing errors. Thus what is important is that the minimum is found either if the distance between the selected color and the boundary is minimal. An extra demand may be that the selected color must lie within the (quantized) boundary.

Thus, the method of dynamic gamut control decreases the intensity of one of the color primaries at a time such that the resulting color gamut becomes smaller due to the change of only one of the color primaries. The resulting color gamut, which is referred to as the adjusted color gamut, is made smaller until a first color of the input image is encountered which lies substantially on the boundary of the adjusted color gamut. Then, the intensity of the next color primary may be decreased until an another first color of the input image is encountered which lies on the boundary of the adjusted color gamut. This approach may be applied to every one of the color primaries. The order in which the intensities of the color primaries are decreased can be selected at will.

This step-by-step decrease of the gamut minimizes the intensity of the color primaries and thus the power to be supplied to the light sources, while on the other hand care is taken to not change the gamut such that any colors of the image are outside the gamut. The actual intensities of the color primaries and thus the resulting gamut are dynamically controlled to fit all the colors of the actual image with minimal intensity of the primaries.

In an embodiment, the method may be recursive in that after all color primaries have been minimized, again the color primary which was decreased first is checked whether a further decrease is possible, and so on for the other color primaries. This recursive approach is advantageous if the color gamut changes in the direction of a particular one of the color primaries, which is not varied. For example, in a RGBW display the light sources produce three spectra, one for each one of the associated red, green and blue sub-pixels. The spectrum of the light impinging on the white sub-pixel is the addition of these three spectra. Thus, the color of the white pixel changes when the intensity of one of the R, G, B light sources is controlled. Consequently, also the color gamut changes in another direction than caused by the varying intensity of the light source, which is varied, and the first pixel, which was on the boundary in this other direction may move into the varied gamut rather than stay on its boundary.

In an embodiment, initial intensity values of the set of color primaries are selected to obtain an initial color gamut containing all colors of the set of colors present in an input image, which should be displayed. The method further, for the color primary of the set of color primaries which is adjusted, starting from the initial intensity value of this color primary, adjusts the color primary which is adjusted to obtain the adjusted color primary of which the minimal value is searched for.

In an embodiment, the set of color primaries comprises N color primaries. For each one of the colors of the set of colors, the minimal intensity values of the color primaries are selected to be able to display this color in the N dimensional color gamut formed by the set of color primaries. Then, the initial intensity value per color primary is determined by selecting the maximum value of the minimal intensity values found for the corresponding color primaries. If the N color primaries are obtained with color filters from $P<N$ light sources, the minimal intensity values of the color primaries are found by determining the minimal light output of the P light sources.

In an embodiment, the set of color primaries comprises N color primaries, which define an N dimensional color gamut. The searching for the minimal intensity value of the adjusted color primary is simplified by performing this search in a number of two-dimensional spaces instead of in the N-dimensional color gamut. These two-dimensional spaces form two-dimensional color gamuts. The color of the set of colors, which form the input image is projected into these two-dimensional color gamuts. The minimal intensity value of a particular one of the color primaries can be determined by finding the minimal intensities on all two-dimensional planes in which one of the primaries is this particular color primary. The minimal intensities are the intensities at which the projected color lies on a boundary of the two-dimensional color gamut. These planes are also referred to as two-dimensional sub-spaces of the N-dimensional color gamut.

To conclude, for each color of the set of colors and for each two-dimensional sub-space of the N dimensional color gamut defined by the adjusted color primary, the intensity value of the adjusted color primary is determined to obtain an adjusted two-dimensional color gamut wherein a projection of the selected color of the set of colors lies on a boundary of the adjusted two-dimensional color gamut. The maximum value of the adjusted color primaries determined in the two-dimensional sub-spaces defined by the adjusted color primary is selected as the minimal intensity value of the adjusted color primary.

In an embodiment, for each color of the set of colors, the minimal intensity value of the adjusted color primary is found by substituting coordinates of the projection of the selected color of the set of colors in an equation defining a boundary line of the boundary of the adjusted two-dimensional color gamut. Consequently, the intensity value of the adjusted color primary for which the color lies on a boundary of the two-dimensional color gamut is easily found by using linear equations defining lines. It is not required to perform difficult matrix operations in an N-dimensional space.

In another aspect of the invention, the display apparatus comprises a dynamic gamut control unit and pixels comprising sub-pixels. The dynamic gamut control unit comprises a driver for controlling intensities of a set of color primaries, which illuminate associated sub-pixels of a pixel of the display device. The gamut control unit comprises a processor, which selects initial intensity values of the set of color primaries to obtain an initial color gamut containing all colors of a set of colors defining an input image. Then, sequentially per color primary of the set of color primaries, the processor adjusts the initial intensity value of one of the color primaries to obtain an adjusted color primary. The processor searches for a minimal intensity value of the adjusted color primary to obtain together with the other color primaries of the set of color primaries an adjusted color gamut still containing all the colors of the set of colors. This search is performed for each color of the set of colors by determining the intensity value of the adjusted color primary such that the adjusted color gamut is obtained wherein the selected color of the set of colors lies on a boundary of the adjusted color gamut. Finally, the maximum value of the determined intensity values of the adjusted color primary is selected to be the minimum value for the adjusted color primary at which all colors are still within the color gamut of the color primaries.

In an embodiment, the set of color primaries comprises N color primaries, and the pixel comprises N sub-pixels. The display apparatus further comprises a set of P light sources, which generate the light for the set of N color primaries. The driver is coupled to the P light sources for controlling the intensities of the light sources to vary the intensities of the set of N color primaries. A set of N color filters is arranged between the set of P light sources and the N sub-pixels. The set of N color primaries is formed by the light leaving the N color filters. The display apparatus further comprises a sub-pixel driver for controlling an optical state of the N sub-pixels.

In an embodiment, one of the color filters of the set of N color filters is transparent. As elucidated earlier, this white color filter causes a primary color of which the color depends on the intensities of the other color primaries. Or said differently, the color after the white filter is determined by the intensities of the light sources of which at least part of the spectrum is able to pass the white filter. Consequently, if the color gamut defined by all the color primaries changes because the intensity of one of the not white color primaries (thus the intensity of one of the light sources) is changed, also the white color primary changes. This change of the white color primary may cause a color of the input image, which was positioned on a boundary of the color gamut before the color primary was changed to not longer lie on the boundary. This problem is solved by applying the present approach at least two times for the intensities of all light sources. Or said differently, after the minimal intensity for each one of the P light sources is determined in accordance with the present invention such that the colors of the input image are within the resulting gamut defined by the N minimized color primaries, again the minimal intensity for each one of the P light sources is determined in accordance with the present invention. If required, the approach in accordance with the present invention may be repeated more than two times.

In an embodiment, the display apparatus has three differently colored light sources and four color primaries are present. It has to be noted that the differently colored lights sources may be three different lamps, or one fluorescent lamp providing a spectrum with three bands, or at least one LED per color. The sub-pixel driver comprises a mapper for mapping the three-color component input signal into the four drive values for the four sub-pixels, and a scaler for scaling the input signal with a factor larger than one. The scaling is performed to enable the use of the full gamut of the four-color primaries.

These and other aspects of the invention are apparent from and will be elucidated with reference to the embodiments described hereinafter.

It should be noted that items, which have the same reference numbers in different Figures, have the same structural features and the same functions, or are the same signals. Where the function and/or structure of such an item have been explained, there is no necessity for repeated explanation thereof in the detailed description.

DETAILED DESCRIPTION

Figure 1:
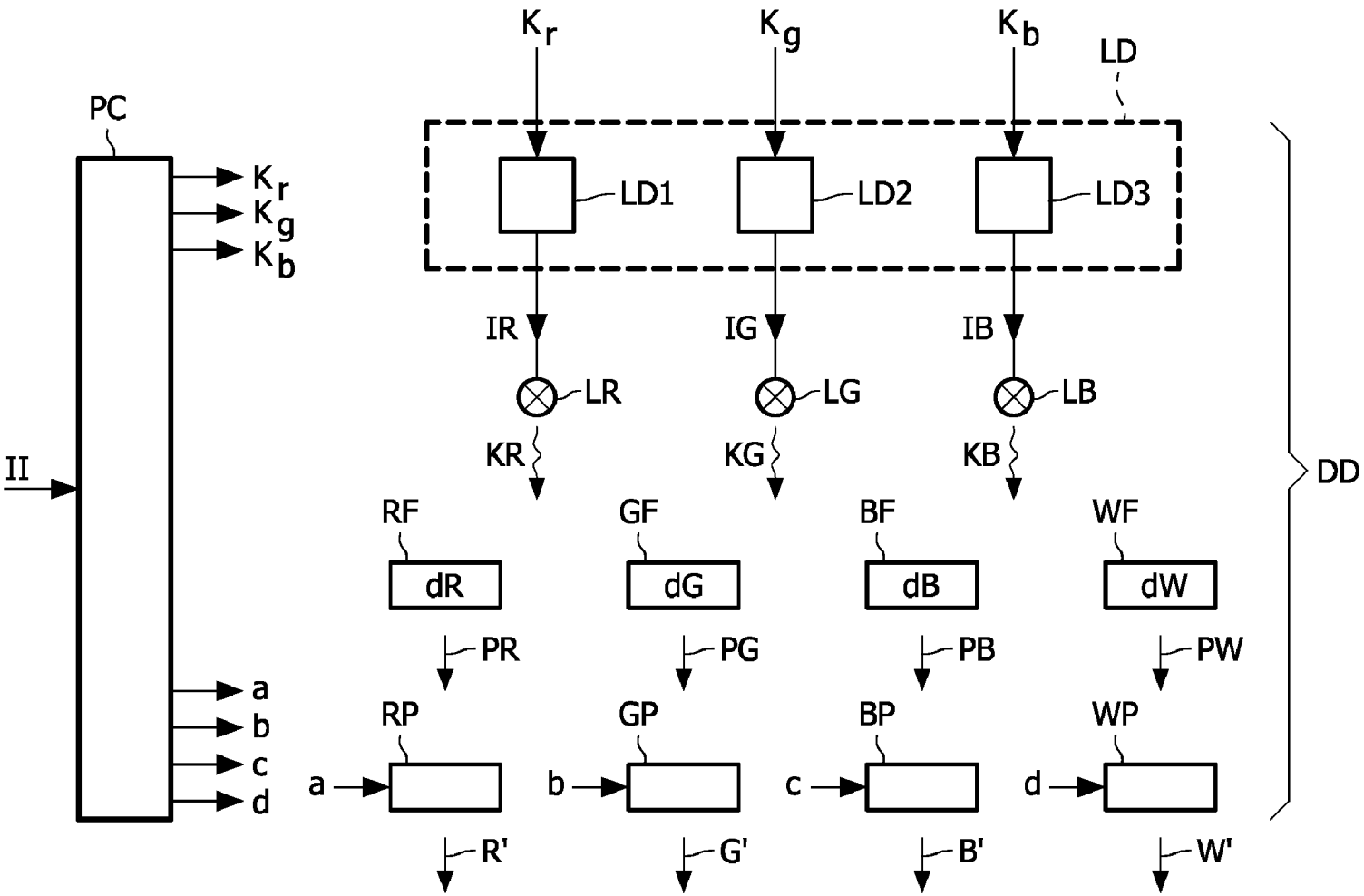
FIG. 1 shows a schematic block diagram of a processor and a display device.

FIG. 1 shows a schematic block diagram of a processor and a display device. The display device DD uses N color primaries, which are generated by P light sources via N color filters, which have a particular transmission. In FIG. 1 an example is shown with N=4 primaries PR, PG, PB, PW, three light sources LR, LG, LB, and four color filters RF, GF, BF, WF. In the now following the invention is elucidated with respect to this example because an explanation for larger values of N and P would become needless complex. The skilled person will easily be able to understand from the explanation with respect to this example that the invention is applicable to a general case for N primaries, P light sources, and N color filters.

The color primaries PR, PG, PB, PW illuminate the associated sub-pixels RP, GP, BP, WP, respectively of a pixel of the display device DD. The optical state of the sub-pixels RP, GP, BP, WP is controlled by the control signals a, b, c, d, respectively, in accordance with the input signal II. The control signals a, b, c, d modulate the color primaries PR, PG, PB, PW to provide the intensity of the light R', G', B', W' leaving the sub-pixels RP, GP, BP, WP required to obtain the color of the associated pixel in the input signal II. It has to be noted that in a practical implementation the color filters RF, GF, BF, WF may alternatively be present below the sub-pixels RP, GP, BP, WP In the embodiment shown in FIG. 1, N is four and P is three. However, any other numbers of N and P may be used as long as N is larger than two, and P can be any number, but mostly smaller than or equal to N. Although the capital letters R, G, B, W indicate the colors red, green, blue and white respectively, any other colors having different spectra may be use. The spectrum of the white color W may be the sum of the spectra of the other colors R, G, B filtered by the white filter WF. For the ease of explanation, in the now following the display device DD is considered to be an RGBW display which has red, green, blue and white primaries PR, PG, PB and PW, respectively. However, the skilled person will readily understand how to change this particular embodiment to any other display having other primaries. It has to be noted the white primary PW is called white because the white filter WF can be transparent for all the visible light wavelengths. The transmission dW of the white filter WF may be 100% for all the wavelengths. However, in most practical implementations, the white sub-pixel WP is covered by a transparent layer with a particular transmission spectrum and thus a transmission smaller than 100%, which is different for different wavelengths. For example, the white filter WF may transmit yellow or other spectra. Also, the use of the word "white" is only related to the fact that the white filter WF is transparent; the actual color of the white primary PW depends on the actual intensities of the light sources LR, LG, LB and thus may have any color.

A driver LD comprises the sub-drivers LD1, LD2 and LD3. The sub-driver LD1 receives an input control value Kr and supplies the current IR to the light source LR which produces red light with an intensity KR. The sub-driver LD2 receives an input control value Kg and supplies the current IG to the light source LG, which produces green light with an intensity KG. The sub-driver LD3 receives an input control value Kb and supplies the current IB to the light source LB, which produces blue light with an intensity KB. The light sources LR, LG, LB may be separate lamps, such as for example fluorescent lamps, or LED's (Light Emitting Diodes) or groups of LED's. The input control values Kr, Kg, Kb may control the currents IR, IG, IB supplied to the light sources LR, LG, LB by varying a level and/or a duty-cycle of these currents IR, IG, IB. The processor PC receives the input signal II and supplies the control values Kr, Kg, Kb and the control signals a, b, c, d. The actual processing is not elucidated because it is well known how to drive an RGBW display. In the now following will be elucidated which processing has to be added to be able to perform the present invention. This processing may be performed by dedicated hardware or by a software program running on a microprocessor.

Figure 2:
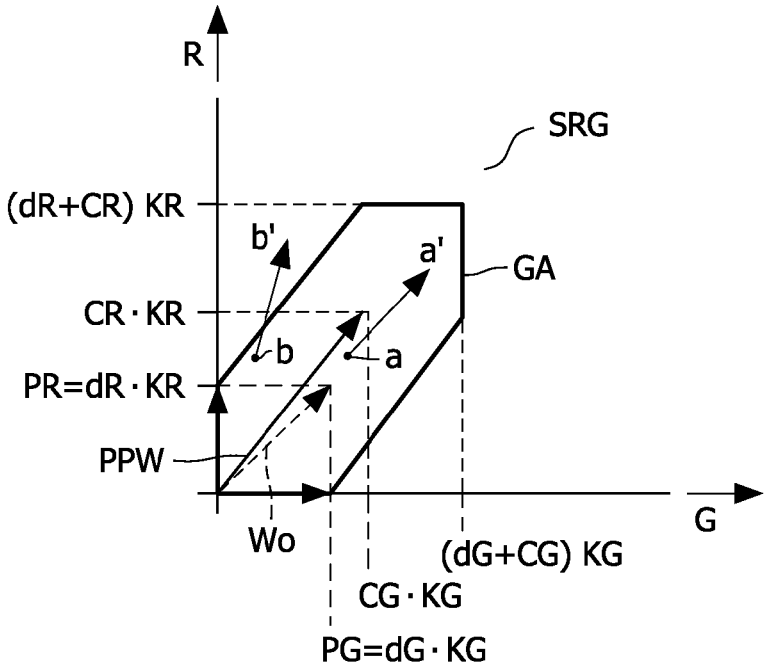
FIG. 2 schematically shows a two-dimensional gamut to elucidate the effect of boosting the primaries in an RGBW display, FIG. 3 schematically shows a two-dimensional gamut to elucidate the effect of boosting and dimming the primaries in an RGBW display for minimizing the power consumption while all colors in the input image are within the gamut, FIG. 4 schematically shows a two-dimensional gamut to elucidate how the intensity of a first one of the primaries is minimized in a first step, FIG. 5 schematically shows a two-dimensional gamut to elucidate how the intensity of a second one of the primaries is minimized in a first step, FIG. 6 schematically shows a two-dimensional gamut to elucidate how the intensity of a third one of the primaries is minimized in a first step, FIG. 7 schematically shows a two-dimensional gamut to elucidate how the intensity of a first one of the primaries is minimized in a second step, FIG. 8 schematically shows a two-dimensional gamut to elucidate how the intensity of a second one of the primaries is minimized in a second step, FIG. 9 schematically shows a two-dimensional gamut for explaining the calculation for determining the minimal intensity of a primary such that a color of the input image occurs on a boundary of the gamut.

FIG. 2 schematically shows a two-dimensional gamut to elucidate the effect of boosting the primaries in an RGBW display. This two-dimensional gamut is a projection gamut of the four-dimensional gamut created by the four primaries PR, PG, PB, PW. If N primaries are used, this two-dimensional gamut is a projection-gamut of the N-dimensional gamut defined by the N primaries. For simplicity, the approach is elucidated with respect to two-dimensional projections of the N-dimensional gamut.

FIG. 2 shows the RG sub-space SRG. In an RGBW display with the three controllable light sources LR, LG and LB, besides the RG sub-space SRG, two other sub-spaces (not shown) can be defined: the RB sub-gamut and the GB sub-gamut. The vertical axis of the RG sub-space shows the intensity of the red color, and the horizontal axis shows the intensity of the green color. The red primary vector PR, which lies on the vertical axis has a length PR=dR*KR, wherein KR represents the intensity of the light generated by the red light source LR, and wherein dR is the filter transmission factor of the red filter RF. The green primary vector PG, which lies on the horizontal axis has a length PG=dG*KG, wherein KG is the intensity of the light generated by the green light source LG, and wherein dG is the filter transmission factor of the green filter GF. The component of the white primary PW projected from the three-dimensional RGB color space to the two-dimensional RG color space is indicated by PPW. The white primary PPW is defined by:

$$PPW=KR*dW1+KG*dW2+KB*dW3=CR*KR+CG*KG+CB*KB.$$

Wherein dW1, dW2, dW3 indicate the spectral filtering of the white filter WF. Thus the filter factor dW shown in FIG. 1 may depend on the wavelength of the impinging light. It is assumed that the white filter WF has a constant or almost constant transmission CR, CG, CB, for the red light KR, the green light KG and the blue light KB, respectively. Thus the white vector PPW ends at the points: G=CG*KG and R=CR*KR. The total sub-gamut GA of colors, which can be reproduced by the primaries in the red-green sub-space SRG is defined by the vectors PR, PG and PPW and is indicated by GA. It has to be noted that the white primary PW need not be white; the actual color depends on the coefficients CR, CG and CB and on the intensities KR, KG and KB. Consequently, the white vector PPW, which is the projected white primary PW, need not coincide with the projected white WD, which is obtained when all the primaries PR, RG, RB have intensity one.

If the RGBW display device DD has a same resolution as an RGB display device, the RGBW sub-pixels have a 25% reduced area with respect to the RGB sub-pixels. Dependent on the transmission dW of the white filter and the color of to be displayed, a 50% higher brightness, or a 50% lower power consumption at the same brightness is possible in a RGBW display with respect to a RGB display. However, the use of RGBW displays with fluorescent lamps, as the backlight is limited due to artifacts caused by the RGB to RGBW gamut mapping. In order to make use of the full brightness of the RGBW gamut, the input image II has to be scaled approximately by a factor of two. Thus, all colors become a factor two brighter, see for example the unsaturated color a which becomes a', and the saturated color b which becomes b'. Consequently, the scaling causes some saturated colors to move outside of the gamut GA, which can be reproduced. This leads to undesirable clipping artifacts or unnaturalness after mapping such colors back into the reproduction gamut GA.

The gamut GA can be enlarged by boosting the light sources LR, LG, LB with the same scaling factor and thus enlarging the vectors PR, PG and PPW until all possible input colors can be reproduced by the gamut GA. But, of course this would enormously increase the power consumption.

If a single fluorescent lamp is used for the light sources LR, LG, LB, the primaries PR, PG, PB and PW are equally enlarged, thereby increasing the luminance while preserving hue and saturation. In this embodiment the light sources LR, LG, LB are not separate light sources but are obtained by different phosphors in the same fluorescent lamp. This approach avoids clipping but increases the power consumption and lowers the lifetime of the lamp. If the light sources LR, LG, LB are separate LED's or LED arrays, the brightness of the LED's can be controlled separately as is shown in FIG. 1. This freedom is used in the present invention to separately control the luminance of the lights KR, KG, KB to adapt the shape of the resulting gamut such that these luminances are minimal while still all colors of the actual input image are reproduced. This gamut control is dynamic because it adapts the gamut dependent on the colors comprised in the actual input image, part of the input image, or a set of input images.

Figure 3:
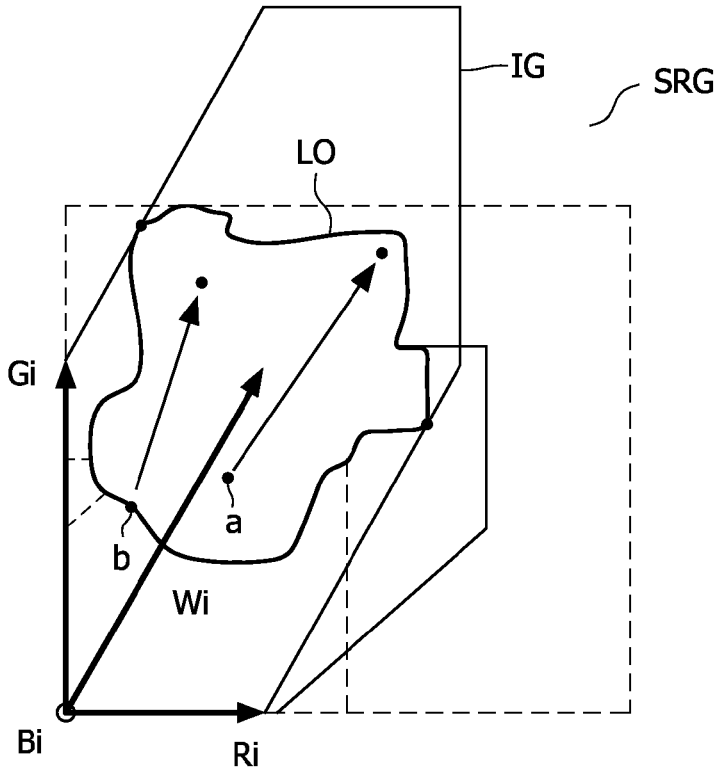

FIG. 3 schematically shows a two-dimensional gamut to elucidate the effect of boosting and dimming the primaries in an RGBW display for minimizing the power consumption while all colors in the input image TI are within the gamut. Dependent on the color content of the input image II the primaries may be scaled differently. In FIG. 3, none of the colors of the input image II occur outside the area bounded by the locus LO. Some of the colors are indicated by a dot. The intensities of the light sources LR, LG, LB are controlled such that the primaries PR, PG, PB and PW have the minimal values Ri, Gi, Bi and Wi causing a gamut IG which is as small as possible but encompasses all the colors of the input image II. For the sake of simplicity, in FIG. 3 only red and green colors are present in the input image II such that the blue primary PB is zero.

This approach of boosting and dimming of the primaries has two advantages: first no artifacts will occur because none of the colors of the input image II is outside the reproduction gamut IG, and secondly, the intensity KR, KG, KB of the light sources LR, LG, LB is minimal and thus the power consumption is minimal. To obtain this behavior the dynamic gamut control in accordance with the present invention has to be added to the processing chain.

The non pre-published European patent application 06114488.7 (24 May 2006) discloses an algorithm which applies the constraint that two of three scaling factors KR, KG, KB of the primaries PR, PG, PB, PW are substantially equal. This assumption simplifies the algorithm, however the implementation is still difficult and expensive and will not provide the optimal solution. In another algorithm all three scaling factors can be different. However, the algorithm requires a significant amount of iterations since it is not fully stable converging. This algorithm uses the multi-primary conversion algorithm at each iteration, which greatly increases complexity.

The operation of the approach in accordance with the invention will be elucidated with respect to FIGS. 4 to 8.

Figure 4:
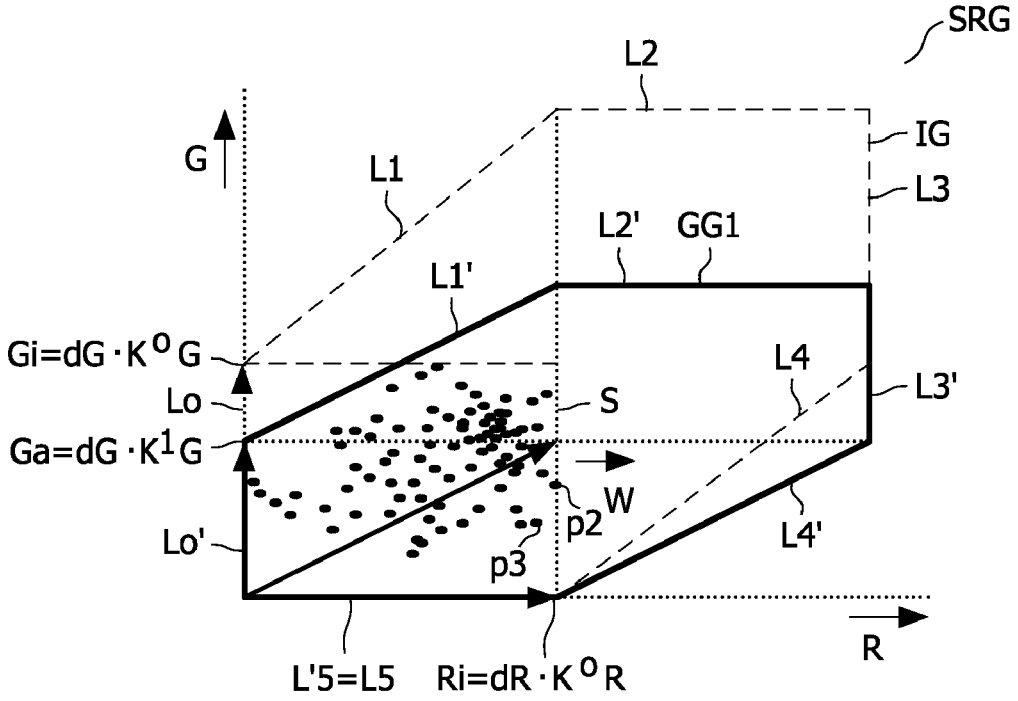

FIG. 4 schematically shows a two-dimensional gamut to elucidate how the intensity of a first one of the primaries is minimized in a first step. For any value of the control factors Kr, Kg, Kb and thus the corresponding luminances KR, KG, KB generated by the light sources LR, LG, LB, respectively, the reproduction gamut is defined by the primaries PR, PG, PB and PW. These primaries PR, PG, PB, PW are vectors in the display color space defined by the three-dimensional color space RGB. For the ease of explanation, in FIG. 4 only the two-dimensional color sub-space SRG is shown.

The vector $dG*K^0G$ shows the initial value Gi of the primary PG, the vector $dR*K^0R$ shows the initial value Ri of the primary PR. It has to be noted that for the ease of explanation often is referred to a value while in fact the length of the vector is meant. These initial values Gi and Ri are found by first determining for each color of the input image II the minimal intensity value for the corresponding color primary PG, PR, respectively and secondly selecting the maximum value of the minimal intensity values found. It has to be noted that instead of the colors of the input image may be read: the colors of the color set S, because the color set S must not contain the colors of a complete single image, but may also contain the colors of part of an image or of a series of images. Each color present in the set S is represented by one of the dots shown in FIG. 4. The initial value Gi is found by determining for all the dots shown, the minimal value of the primary PG required for the green part of the color of the dot. As is clear from FIG. 4 the maximum value of these minimum values is found for the color P1. Consequently, the initial value Gi has the same G value as the G value of this color P1. Analogously, the initial value Ri is equal to the R value of the color P2 which has the largest R value of all the colors. The resulting initial gamut is indicated by IG. The boundary of the gamut IG is the convex hull defined by the vectors $dR*K^0R$, $dG*K^0G$, $dB*K^0B$, $CR*K^0R+CG*K^0G+CB*K^0B$. The actual color R', G', B', W' presented to the viewer is defined by:

$$(a*dR+d*CR)K^0R,(b*dG+d*CG)K^0G,(c*dB+d*CB)K^0B$$

wherein a, b, c, d are the control factors which determine the amount of transmission or reflectivity of the sub-pixels RP, GP, BP, WP, respectively. The control factors a, b, c, d may vary from zero to one.

In a next step, starting from the initial gamut IG, the minimal value of the primary PG is determined such that still all colors are inside the associated minimal gamut. It can easily be seen in FIG. 4 that decreasing the primary PG starting from the initial value Gi changes the position of most of the line parts L0, L1, L2, L3, L4, L5 which indicate the boundary of the initial gamut IG. The resulting line parts L0', L1', L2', L3', L4', L5' indicate the boundary of the minimal gamut GG1 obtained when only the primary PG is minimized. The minimal gamut GG1 is found by decreasing the value of the primary PG until the first one of the colors occurs on the boundary of the gamut GG1. In the example shown, this is the color P1. For the sake of clarity, this color P1 is shown just below the line L1' although it should lie on this line. The minimal value of the primary PG is $Ga:=dG*K^1G$. Although it can be easily seen in FIG. 4 that the minimal value Ga of the primary PG occurs for the pixel P1, in the approach in accordance with the invention for each color of the set of colors S, it is determined which value of he primary PG is required such that the color lies on an boundary of the resulting gamut. After processing all the colors, the minimal value Ga is the maximum value of the values of the primary PG determined for the each one of the colors of the set S. How to determine whether a color lies on a boundary of a gamut is explained with respect to FIG. 8.

It has to be noted that the shape of the gamuts IG and GG1 differ because the white vector W changes when one of the primaries PR, PG, PB changes due to a change of the intensities KR, KG, KB. With the expression "the shape differs" is meant the shape of the gamut GG1 is not obtained from the shape of the gamut IG by a simple scaling of only one of the primaries.

Figure 5:
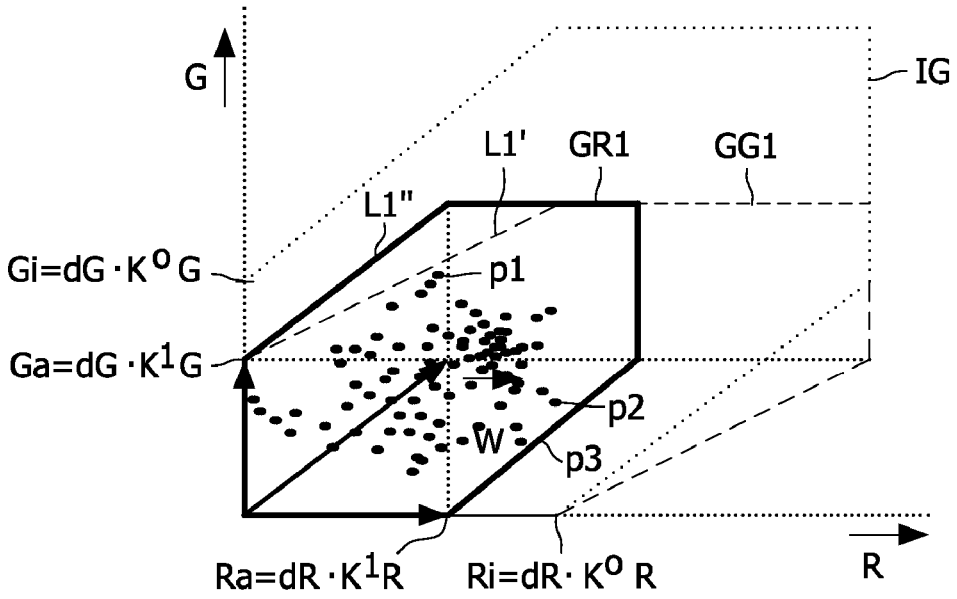

FIG. 5 schematically shows a two-dimensional gamut to elucidate how the intensity of a second one of the primaries is minimized. After the minimal value Ga of the primary PG has been determined, in a next step, the minimal value Ra of the primary PR is determined. FIG. 5 shows the initial gamut IG, the gamut GG1 after minimizing the primary PG, and the gamut GR1 obtained after subsequent minimizing the primary Pr in the gamut GG1. As it is clear from FIG. 5 the minimal value $Ra:=dR*K^1R$ of the primary PR is found by looking which color is the first one which will be on a boundary of the resulting gamut. In the example shown, this is the color P3 of which the dot is invisible due to thick line indicating the gamut GR1. The gamut GR1 is defined by the minimal value Ga of the primary PG found in the earlier step and the minimal value Ra of the primary PR in this step. The determination of the minimal value Ra can be performed in the same manner as for the minimal value Ga.

Figure 6:
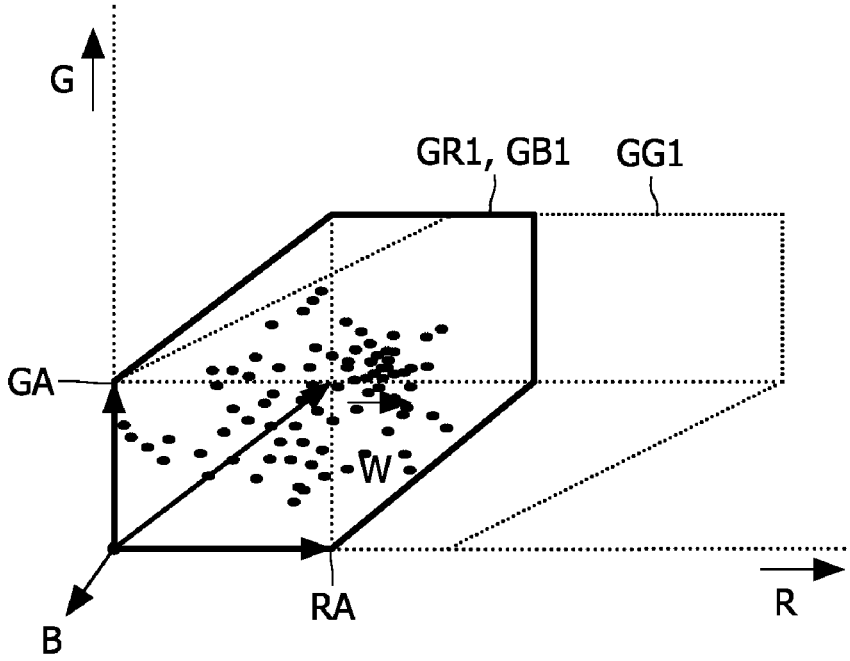

FIG. 6 schematically shows a two-dimensional gamut to elucidate how the intensity of a third one of the primaries is minimized in a first step. In this step the minimal value Ba (not shown) of the primary PB (not shown) is searched for. The axis along which the primary PB extends is indicated by B. This axis extends perpendicular to the GR plane shown in FIG. 6. In the example shown, the projection of the gamut GB1 on the GR plane is identical to the gamut GB1. The gamut GB1 is defined by the minimal value Ba together with the earlier found minimal values Ra and Ga. The minimal value Ba can be found in a similar manner as the minimal values Ra and Ga are determined.

It has to be noted that due the changing value of the primary PR (and also due to the changing primary PB), also the white vector W changes. This causes the shape of the gamut GR1 to differ from the shape of the gamut GG1. In the example shown, due to the change of the shape when changing the primary PR, the line L1' shifts to the position indicated by L1" and consequently the color P1 which was on a boundary of the gamut GG1 after the minimization of the primary PG does not anymore lie on a boundary of the gamut GR1. This boundary shifting due to the changing white vector W can be counteracted by applying the approach iteratively. Thus, after first finding one by one the minimum values Ga, Ra, Ba of the primaries PG, PR, PB, respectively, again a cycle is started wherein the minimum values Gb, Rb, Bb of the primaries PG, PR, PB, respectively one by one are determined. It has been found that the minimal values Ga, Ra, Ba of the primaries PG, PR, PB found after one cycle are in average 7% and at maximum 20% larger than the real minimal values. After a second cycle, the values Gb, Rb, Bb are in average only 0.1% and at maximum only 0.7% away from the real minimal values.

Figure 7:
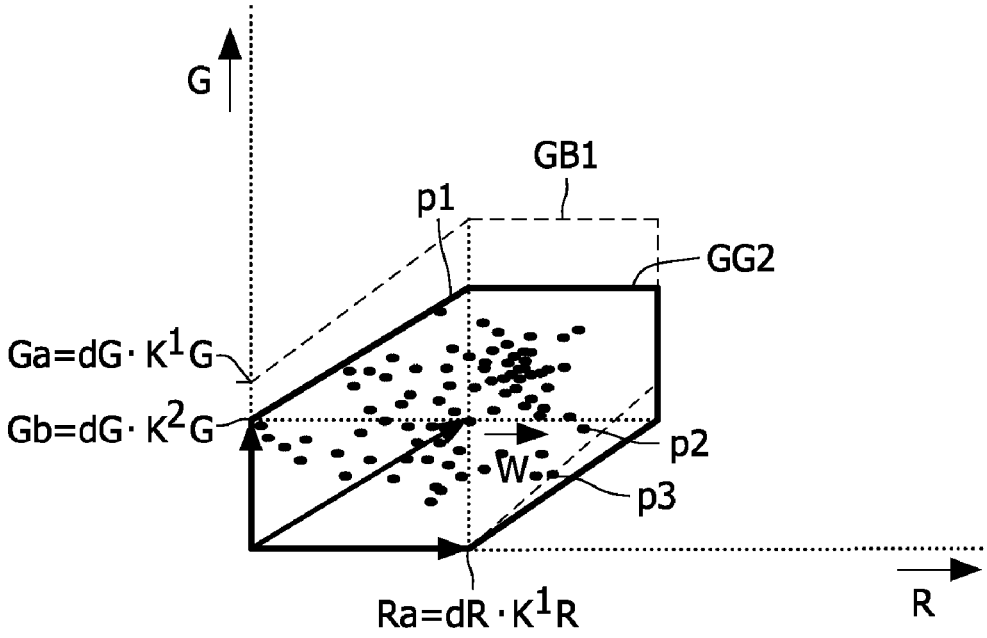

FIG. 7 schematically shows a two-dimensional gamut to elucidate how the intensity of a first one of the primaries is minimized in a second step. FIG. 7 shows the gamut GB1 obtained after minimizing in the first cycle all the primaries PR, PG, PB by minimizing the intensity of the light sources LR, LG, LB, respectively. The gamut GB1 slightly differs from the gamut GR1 shown in FIG. 5 due to the influence of the minimizing of the primary PB. Again, in the same manner as elucidated with respect to FIG. 4, the minimum value Gb of the primary PG is determined by first determining for each color of the set S which value of the primary PG correspond to a gamut of which a boundary coincides with the color, and then taking the maximum value of all the values found. In the example shown, the minimal value Gb of the primary PG is again found for the color P1, and the corresponding gamut is indicated by GG2. This second minimizing step may be more efficient if during the first step is stored which colors have the highest values of the primary PG, and to only check these colors.

Figure 8:
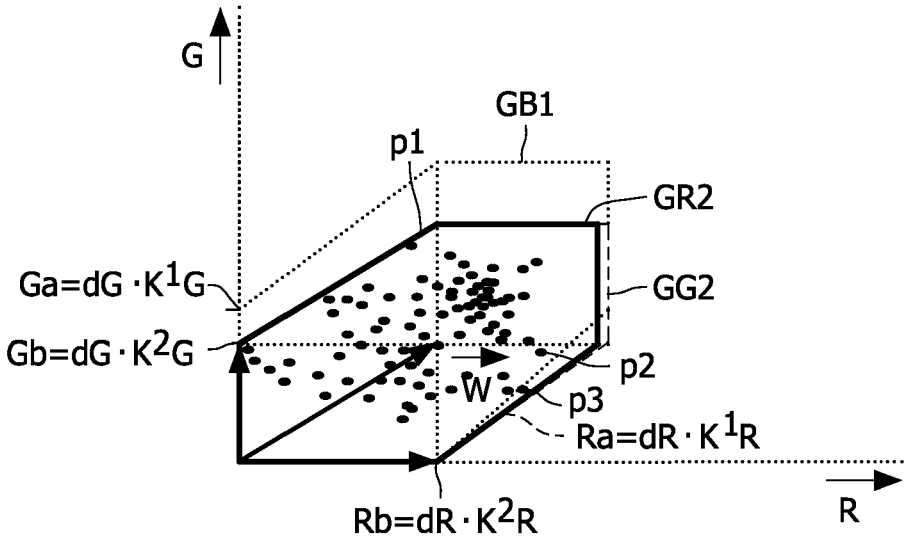

FIG. 8 schematically shows a two-dimensional gamut to elucidate how the intensity of a second one of the primaries in minimized in a second step. FIG. 8 shows the gamut GB1 obtained after minimizing in the first cycle all the primaries PR, PG, PB one by one, and the gamut GG2 as explained with respect to FIG. 7. In the same manner as elucidated with respect to FIG. 5, the minimum value Rb of the primary PR is determined by first determining for each color of the set of colors S which value of the primary PR correspond to a gamut of which a boundary coincides with the color, and then taking the maximum value of all the values found for the pixels of the set S. In the example shown, the minimal value Rb of the primary PR is again found for the color P3, and the corresponding gamut is indicated by GR2. This second minimizing step of the primary PR may be more efficient if during the first step is stored which colors have the highest values of the primary PR, and to only check these colors during this second step.

Figure 9:
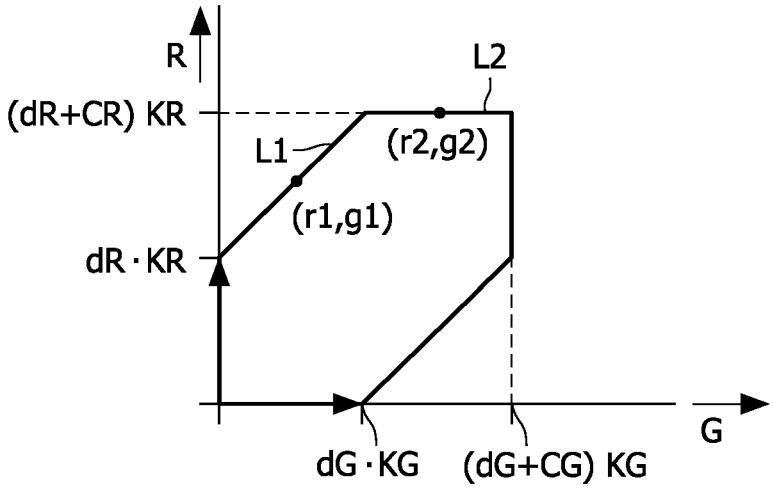

FIG. 9 schematically shows a two-dimensional gamut for explaining the calculation for determining the minimal intensity of a primary such that a color of the input image occurs on a boundary of the gamut. It has to be noted that the minimal value of a particular primary can be directly determined in the P dimensional space defined by the controllable light intensities KR, KG, KB, . . . , or in the N dimensional color space defined by the N primaries PR, PG, PB, PW, . . . . However, the computations become much simpler if performed in the two-dimensional color sub-spaces (thus planes) of the P or N dimensional space. Each one of these color sub-spaces is defined by two of the P light intensities KR, KG, KB, . . . and a projection on the two-dimensional sub-space of the resulting other primaries which depend on more than one of the P light intensities, such as for example the white primary PW. For example, for the RGBW display, three sub-spaces or planes exist: the R-G plane defined by the intensity vectors KR and KG (in fact the primaries PR and PG) and the projection of the white primary PW on this plane, the R-B plane defined by the intensity vectors KR and KB and the projection of the white primary PW on this plane, and the G-B plane defined by the intensity vectors KG and KB and the projection of the white primary PW on this plane. The minimum value of the primary which is the variable is determined by calculating, in each of the planes in which this primary is defined, for each color of the set S projected on the planes, the value of the primary for which this color lies on a boundary line of the resulting gamut. The maximum value of the primary values calculated is the minimum value in this plane. The allowable minimum value of the primary for which all colors of the color set S are within the boundary, and at least one color lies on the boundary, is the maximum value of the maximum values determined in the two relevant ones of the three planes.

The calculation of the value of the variable intensity vector is explained with respect to FIG. 9 for the boundary lines L1 and L2 when the primary PR is the variable and the primaries PG and PB are fixed. The same approach is applicable for the relevant lines of the boundary of the gamut when one of the other primaries is the variable.

For a color (r2, g2) which lies on the line L2 which occurs if G≧dG*KG holds:

$$R=r2/(dR+CR) \text{ if } G \geqq dG*KG$$

For a color (r1, g1) which lies on the line L1 which occurs if G<dG*KG holds:

$$R=r1/(dR+g1*CR/(CG*KG)) \text{ if } G<dG*KG.$$

Or said more in general, the minimal R value KR equals:

$$KR=\max(\text{for all } r,g,b \in S) \text{ of } \min(KR \text{ value } ((r,g,b) \in G(KR,KG,KB)),$$

wherein r,g,b define the colors of the set of colors S, KR is the variable light intensity and KG and KB are the fixed intensities, max indicates: taking the maximum value, G(KR, KG, KB) is the gamut defined by value of the variable KR and the fixed values of KG and KB, and min( . . . ) indicates taking the minimum value of KR for which the color (r,g,b) lies on the boundary of the gamut G and thus is reproducible with the gamut G.

The determination in the two-dimensional sub-spaces is defined by:

$$\min(KR \text{ value } ((r,g,b) \in G(KR,KG,KB))=\max(\min KR \text{ value } ((r,g) \in G(KR,KG)), \min KR \text{ value } ((r,b) \in G(KR,KB)),$$

wherein $$\min KR \text{ value } ((r,g) \in G(KR,KG))=KR=r/(dR+CR) \text{ if } G \geqq dG*KG$$

$$KR=r/(dR+g*CR/(CG*KG)) \text{ if } G<dG*KG, \text{ and}$$

$$\min KR \text{ value } ((r,b) \in G(KR,KB))=KR=r/(dG+CR) \text{ if } B \geqq CB*KB$$

$$KR=r/(dG+g*CR/(CB*KB)) \text{ if } G<CB*KB.$$

Figure 10:
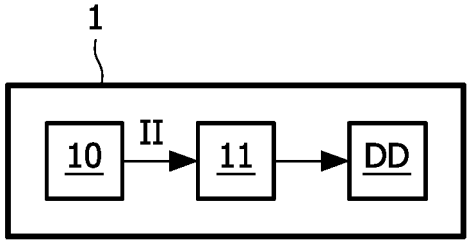
FIG. 10 shows a block diagram of a camera.

FIG. 10 shows a block diagram of a handhold apparatus with a display. The portable device 1 comprises a unit 10 for providing an input image II, a unit 11, and the display DD. The unit 11 comprises the driver LD and the processor PR for generating the control value Kr, Kg, Kb to the driver LD and the control values a, b, c, d to the display DD. The unit 10 may be configured to establish a wireless connection with an image provider, such as for example photos or video. The wireless connection may be established with a server of a local network or via internet. Alternatively, the unit 10 may comprise a storage device, such as for example a hard disk, an optical storage medium, or solid-state memory, or may comprise a sensor of a video or photo camera.

It should be noted that the above-mentioned embodiments illustrate rather than limit the invention, and that those skilled in the art will be able to design many alternative embodiments without departing from the scope of the appended claims.

For example, the approach can also be applied on a RGB display to minimize the intensities of the primaries to minimize the power consumption without creating outliers (colors of the input image which cannot be reproduced with the reproduction gamut). It has to be noted that the approach must not be applied on a complete single image; it also works on a part of the input image or on a set of multiple input images. An extra pre-processing step may be added to select the sub-set of pixels S from the input image. For example, the sub-set S may be defined as a set of boundary points of a convex hull over the image. If the algorithm is applied only on the sub-set S of points of the convex hull, the minimal gamut is obtained, which contains the convex hull and hence contains the whole image.

It is not relevant in which order the primaries are minimized.

The light sources LR, LG, LB may be provided in a backlight unit.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A method, operable in a processor for, dynamic gamut control comprising:

controlling (LD) intensities of at least one color light source (LR, LG, LB), which generate a set of color primaries (PR, PG, PB, PW) associated with corresponding sub-pixels (RP, GP, BP, WP) of a display device, and searching (PC) for a minimal intensity value (Ra, Ga, Ba) of said at least one of said color light sources to obtain a set of color primaries (PR, PG, PB, PW) such that an adjusted color gamut G contains all colors of a set of colors (S) by:

for each color X of the set of colors (S), determining (PC) a minimal intensity value (Ra(X); Ga(X); Ba(X)) of the color light source being adjusted to obtain an adjusted color gamut G(X) of the color X wherein the selected color X of the set of colors (S) lies substantially on a boundary of the adjusted color gamut G, and selecting (PC) a maximum value of the determined minimal intensity values (Ra(X); Ga(X); Ba(X)) of the color light sources being adjusted over the set of colors (S).

2. The method of dynamic gamut control as claimed in claim 1, further comprising:

selecting (PC) initial intensity values (Ri, Gi, Bi) of the color light sources to obtain an initial color gamut (IG) defined by the set of color primaries (PR, PG, PB, PW), the initial color gamut (IG) containing all colors of the set of colors (S) of an input image (II), and that the searching (PC) for the minimal intensity value (Ra; Ga; Ba) starts from the associated initial intensity value (Ri, Gi, Bi).

3. The method of dynamic gamut control as claimed in claim 2, wherein the selecting (PC) initial intensity values (Ri, Gi, Bi) comprises:

determining (PC) in the gamut formed by the set of color primaries (PR, PG, PB, PW) for each one of the colors X of the set of colors (S) the minimal intensity of the color light sources required to display this color, and determining (PC) the initial intensity values (Ri(X), Gi(X), Bi(X)) of each one of the color light sources by selecting a maximum value of the corresponding minimal intensity values (Ri(X), Gi(X), Bi(X)) over the set of colors (S).

4. The method of dynamic gamut control as claimed in claim 1, wherein the set of color primaries (PR, PG, PB, PW) comprises N color primaries defining an N-dimensional color gamut, and wherein the searching (PC) for the minimal intensity value (Ra; Ga; Ba) of the color light sources being adjusted comprises, for each color X of the set of colors (S) and for each two-dimensional sub-space (SRG) of the N-dimensional color gamut defined by the color light source being adjusted and another color light source, determining (PC) the minimal intensity value (Ra(X); Ga(X); Ba(X)) of the color light source being adjusted to obtain an adjusted two-dimensional color gamut projection wherein a projection of the selected color X of the set of colors (S) lies substantially on a boundary of the adjusted two-dimensional color gamut projection, and selecting (PC) the maximum value of the minimal intensity values (Ra(X); Ga(X); Ba(X)) determined in the two-dimensional sub-space over the set of colors (S) and over the set of two-dimensional sub-spaces.

5. The method of dynamic gamut control as claimed in claim 4, wherein the determining (PC) the minimal intensity value (Ra; Ga; Ba) of the color light source being adjusted comprises, for each color X of the set of colors (S), substituting coordinates of the projection of the selected color in an equation defining a boundary line of the boundary of the adjusted two-dimensional color gamut to calculate the minimal intensity value (Ra (X); Ga(X); Ba(X)) of the color light source being adjusted for obtaining an adjusted two-dimensional color gamut wherein a projection of the selected color of the set of colors (S) lies substantially on a boundary of the adjusted two-dimensional color gamut.

6. The method of dynamic gamut control as claimed in claim 1 wherein the searching (PC) for the minimal intensity value (Ra; Ga; Ba) is performed at least once sequentially per color light source.

7. The method of dynamic gamut control as claimed in claim 2, further comprising:

sequentially adjusting (PC) the initial intensity value (Ri; Gi; Bi) of a selected one of the color light sources to obtain an adjusted color primary (PR, PG, PB, PW) and the searching (PR) for the minimal intensity value (Ra; Ga; Ba) of the color light source being adjusted to obtain an adjusted color gamut containing all the colors of the set of colors (S), are performed sequentially at least once for each one of the color light sources.

8. A dynamic gamut control unit comprising:

a driver (LD) for controlling intensities of at least one color light source (LR, LG, LB) of a set of light sources P, said light sources generate a set of color primaries (PR, PG, PB, PW) associated with corresponding sub-pixels (RP, GP, BP, WP, . . . ) of a pixel of a display device (DD), and a processor (PC) for:

searching for a minimal intensity value (Ra; Ga; Ba) of one of the color light sources to obtain an adjusted color gamut G (PR, PG, PB, PW) containing all colors of a set of colors (S), and for each color X of the set of colors (S), determining a minimal intensity value (Ra(X); Ga(X); Ba(X)) of the color light source being adjusted to obtain the adjusted color gamut G(X) wherein the selected color X of the set of colors (S) lies substantially on a boundary of the adjusted color gamut G(X), and selecting a maximum value of the determined minimal intensity values (Ra(X); Ga(X); Ba(X)) of the color light source being adjusted over the set of colors (S).

9. A display apparatus comprising:

a set of pixels, each pixel comprising sub-pixels (RP, GP, BP, WP); and a dynamic gamut control unit comprising:

a driver (LD) for controlling intensities of at least one color light source (LR, LG, LB) of a set of light sources P, said light sources generate a set of color primaries (PR, PG, PB, PW) associated with corresponding sub-pixels (RP, GP, BP, WP), and a processor (PC) for:

searching for a minimal intensity value (Ra; Ga; Ba) of one of the color light sources to obtain an adjusted color gamut G (PR, PG, PB, PW) containing all colors of a set of colors (S), and for each color X of the set of colors (S), determining a minimal intensity value (Ra(X); Ga(X); Ba(X)) of the color light source being adjusted to obtain the adjusted color gamut G(X) wherein the selected color X of the set of colors (S) lies substantially on a boundary of the adjusted color gamut G(X), and selecting a maximum value of the determined minimal intensity values (Ra(X); Ga(X); Ba(X)) of the color light source being adjusted over the set of colors (S).

10. The display apparatus as claimed in claim 9, wherein the set of color primaries (PR, PG, PB, PW) comprises N color primaries, and the pixel comprises N sub-pixels (RP, GP, BP, WP), wherein the display apparatus further comprises:

a set of N color filters (RF, GF, BF, WF) being associated with the set of P light sources (LR, LG, LB) and the N sub-pixels (RP, GP, BP, WP), and a sub-pixel driver (PC) for controlling an optical state of the N sub-pixels (RP, GP, BP, WP).

11. The display apparatus as claimed in claim 10, wherein at least one of the color filters (WF) of the set of N color filters (RF, GF, BF, WF) has a transmittance spectrum at least partly overlapping with a transmittance spectrum of at least one of the remaining color filters (RF, GF, BF).

12. The display apparatus as claimed in claim 11 wherein a number of light sources (LR, LG, LB) is three, wherein the set of color primaries (PR, PG, PB, PW) comprises four color primaries, and wherein the sub-pixel driver (PC) comprises a mapper (PC) for mapping a three color component input signal (II) into four drive values (a, b, c, d) for the four sub-pixels (RP, GP, BP, WP), and a scaler (RP) for scaling the input signal (II) with a factor larger than one.

13. A handheld apparatus comprising:

a dynamic gamut control unit (PC) comprising:

a driver (LD) for controlling intensities of at least one color light source (LR, LG, LB) of a set of light sources P, said light sources generate a set of color primaries (PR, PG, PB, PW) associated with corresponding sub-pixels (RP, GP, BP, WP) of a pixel of a display device (DD), and a processor (PC) for:

searching for a minimal intensity value (Ra; Ga; Ba) of one of the color light sources to obtain an adjusted color gamut G (PR, PG, PB, PW) containing all colors of a set of colors (S), and for each color X of the set of colors (S), determining a minimal intensity value (Ra(X); Ga(X); Ba(X)) of the color light source being adjusted to obtain the adjusted color gamut G(X) wherein the selected color X of the set of colors (S) lies substantially on a boundary of the adjusted color gamut G(X), and selecting a maximum value of the determined minimal intensity values (Ra(X); Ga(X); Ba(X)) of the color light source being adjusted over the set of colors (S).

14. A computer program product comprising code, stored in a non-transitory medium, said code when loaded into a processor, causes the processor to execute the steps of:

controlling (LD) intensities of at least one color light source (LR, LG, LB), which generate a set of color primaries (PR, PG, PB, PW) associated with corresponding sub-pixels (RP, GP, BP, WP) of a display device, and searching (PC) for a minimal intensity value (Ra; Ga; Ba) of said at least one of said light sources to obtain the set of color primaries (PR, PG, PB, PW) such that an adjusted color gamut G contains all colors of a set of colors (S) by:

for each color X of the set of colors (S), determining (PC) a minimal intensity value (Ra(X}; Ga(X); Ba(X)) of the color light source being adjusted to obtain the adjusted color gamut G(X) wherein the selected color of the set of colors (S) lies substantially on a boundary of the adjusted color gamut G(X), and selecting (PC) a maximum value of the determined minimal intensity values (Ra; Ga; Ba) of the color light source being adjusted over the set of colors (S).

* * * * *